United States Patent [19]

Yoshino et al.

[11] Patent Number: 4,548,837

[45] Date of Patent: Oct. 22, 1985

[54] METHOD AND APPARATUS FOR COATING

[75] Inventors: Tetsuya Yoshino; Takashi Kageyama; Kazuo Kato; Takeshi Kishido, all of Tokyo, Japan

[73] Assignee: Konishiroku Photo Industry Co., Ltd., Tokyo, Japan

[21] Appl. No.: 515,057

[22] PCT Filed: Nov. 4, 1982

[86] PCT No.: PCT/JP82/00428

§ 371 Date: Jun. 23, 1983

§ 102(e) Date: Jun. 23, 1983

[87] PCT Pub. No.: WO83/01585

PCT Pub. Date: May 11, 1983

[30] Foreign Application Priority Data

Nov. 4, 1981 [JP] Japan ..... 56-175801

[51] Int. Cl.[4] ..... B05D 1/26; B05D 1/30

[52] U.S. Cl. ..... 427/209; 427/420; 427/402; 118/62; 118/410; 118/411

[58] Field of Search ..... 118/62, 325, 415, 410, 118/411; 427/209, 420, 402

[56] References Cited

U.S. PATENT DOCUMENTS

| | | | |
|---|---|---|---|
| 3,065,098 | 11/1962 | Brooks | 118/62 X |
| 3,496,005 | 2/1970 | Ishiwata et al. | 118/62 X |
| 4,241,111 | 12/1980 | Hamamura et al. | 427/211 |

FOREIGN PATENT DOCUMENTS

| | | |
|---|---|---|
| 49-17853 | 5/1974 | Japan . |
| 51-38737 | 10/1976 | Japan . |
| 1582109 | 12/1980 | United Kingdom . |

*Primary Examiner*—Shrive P. Beck

*Attorney, Agent, or Firm*—James E. Nilles; Thomas F. Kirby

[57] ABSTRACT

A method and an apparatus in which gas is jetted out of the gas injector 3' to support the support 2 in a contactless manner, while coating solutions are applied onto both sides of the support 2 by means of the coaters 1 and 1'. Supporting static pressure produced in a gap between the support 2 and the injector 3' is made to become 1/10 through 1/1000 of supply pressure of gas fed into the injector 3', and a lift of the support 2 at the contact point with the coating solution from the coater is made to have a value of 20 through 500μ.

2 Claims, 4 Drawing Figures

METHOD AND APPARATUS FOR COATING

DESCRIPTION

1. Technical Field

This invention relates to a method and an apparatus for coating supports in the floated state. More specifically, this invention relates to a method and an apparatus for applying one or more coating solution on supports such as photosensitive materials which run continuously, while supporting the surface thereof opposite to the coated surface in a contactless manner, and particularly to a method and an apparatus for coating which are suitable to perform both-side coating continuously.

2. Background Art

Heretofore, photosensitive materials having coated layers on both sides of supports have been manufactured as follows. A coating solution is applied on either one side of the support, and the applied coating is gelatinized and dried. Thereafter, the support is passed through the same process to apply, gelatinize and dry a coating solution on the other side thereof. But, to meet a demand for improving production efficiency, there have been proposed various kinds of both-side coating methods with which coating layers are formed on both sides of the support by passing it through the coating and drying process just one time. As one of those methods, there is known such a method that one side of the support is first coated and gelatinized and then its opposite side is coated successively. This method is mainly divided into the following two groups. (I) A method as shown in Japanese Patent Publication No. 44,171/1973, in which one side of the support is first coated and gelatinized, and then its opposite side is coated while bringing the gelatinized side into contact with a supporting roll directly, and (II) a method as shown in Japanese Patent Publication No. 17,853/1974 or No. 38,737/1976, in which gas is jetted from the surface of a supporting roll (i.e., gas injector) having a certain curvature and hence the support is floated, thereby to coat the opposite side in such floated state. The method (I) has disadvantages as follows. If the surface of the supporting roll includes cracks or dusts thereon even to a small extent, this results in a coating failure directly. Thus, maintenance is very difficult. Even if there exists no crack or dust, the coated layer is disturbed when the portion of the support having variation in a thickness of the coated film, such as a beginning portion of coating and a spliced portion, passes the supporting roll while coming into contact therewith, whereby a part of the coated layer adheres onto the roll and this further disturbs the subsequent coated layer. Also, the method (II) is accompanied with such a disadvantage that coating uneveness in the form of horizontal steps tends to generate due to minute fluctuations in floated distance (i.e., lift) of the support which is caused by variation in a tensile force of the support to be coated. Particularly, in the method such that gas is jetted from the curved surface of the roll having small holes and slits to float the coated support and the leading end of an applicator is pressed onto the surface of the support for coating, as disclosed in Japanese Patent Publication No. 17,853/1974, the aforesaid undesirous tendency appears in the end portions of the support remarkably. Meanwhile, in the apparatus such that a roll for supporting both side edges of the support is provided to float and coat the support, as disclosed in Japanese Patent Publication No. 38,737/1976, the aforesaid tendency is increased in the center and in the vicinity thereof of the coated support.

DISCLOSURE OF INVENTION

Therefore, it is an object of this invention to eliminate the disadvantages as mentioned above and to provide a method and an apparatus with which the support to be coated is supported by a gas injector in a contactless manner with the floated distance (i.e., lift) being reduced to permit uniform coating on the opposite side, and thereby to provide a method and an apparatus for coating which permits to coat both sides of the support continuously.

Other objects of this invention will be apparent from the following explanation in this description.

The above object of this invention is achieved as follows. In a coating method wherein a coater and a gas injector are disposed in positions substantially opposite to each other on both sides of a support running continuously, and gas is jetted from the gas injector toward the support to coat it by the coater while supporting the support in a contactless manner, supply pressure (gauge pressure, this applicable to all cases in this description) of gas fed into the injector, a pressure loss in the interior of the injector and a tensile force exerted on the support are set prior to coating so that supporting static pressure produced in a gap between the support and the injector becomes 1/10 through 1/1000 of the supply pressure, and a lift at the contact point with a coating solution from the coater has a value of 20 through 500$\mu$.

Furthermore, the coating method of this invention is practiced using a coating apparatus featured in including a regulator for supply pressure of gas fed into the injector and a regulator for a tensile force exerted on the support which can make it possible that supporting static pressure produced in a gap between the support and the injector becomes 1/10 through 1/1000 of the supply pressure, and a lift at the point of the support with which a coating solution from the coater first comes into contact (i.e., at the contact point) has a value of 20 through 500$\mu$.

As a result of intensive study on the conventional methods and apparatuses for coating which utilize the contactless supporting technique, the inventors have clarified the following. That is, an essential point of the contactless supporting technique is in forming such a space as having higher static pressure than the ambient pressure (i.e., pressure on the side of the support to be coated by the coater), in a gap between the support and the outer surface of the gas injector locating close to each other, thereby to float the support with respect to the gas injector. With this higher static pressure, the support can be supported in a contactless manner (hereinafter, the region where higher static pressure is produced for contactless supporting is referred to as a contactless supporting region). According to such contactless supporting method used in the prior art as well as in this invention, when applying the support subjected to a tensile force with a force perpendicular to the tensile force so as to support it in the curved state, pressure (referred to as back pressure hereinafter) generally represented by T/R (where T: tensile force exerted on the support, R: radius of curvature of the curved portion) is produced at the curved portion in the direction opposite to the force applied for supporting the support. Therefore, static pressure in the above-mentioned higher static pressure space, i.e., supporting static pressure, must be equal to the back pressure. Conversely speaking, the support is fluctuated so as to have a lift at which the back pressure and the supporting static pressure becomes equal to each other.

More specifically, in the higher static pressure space, gas flows into the space from the gas injector at all times, while the gas flows out of the space passing through a narrow gap between the support and the injector, so that it undergoes channel resistance in accordance with a thickness of the gap, i.e., the lift. Thus, the higher static pressure corresponding to the gas inflow and the channel resistance is maintained in the space. Now looking at a relationship among a jet amount of gas, supporting static pressure (i.e., back pressure) and a lift, with the back pressure being constant, the lift is enlarged with the jet amount of gas increasing, but when the jet amount of gas is also invariable, the lift is held at a constant level corresponding to the channel resistance. For instance, if the lift is increased even with other conditions being held constant, channel resistance in the gap is lowered and hence it becomes unable to maintain the supporting static pressure at that time, thus resulting in reduction of the supporting static pressure. An increase in the lift decreases the back pressure, because the value of R in T/R is increased. But this decrease ratio is so much small comparing with reduction in the supporting static pressure, so that the back pressure becomes larger relatively. The support is pushed toward the gas injector and the lift is decreased, whereupon the channel resistance is increased. Finally, the lift is stabilized at such a degree as permitting to maintain the supporting static pressure equal to the back pressure, i.e., at a degree of the lift prior to fluctuations in this case. Such a process where the lift is determined is also applicable to the case that the back pressure is first changed. That is, the lift is always fluctuated such that the back pressure and the supporting static pressure becomes equal to each other, and it assumes a value in accordance with the jet amount of gas at that time. Coating uneveness in the form of horizontal steps encountered in the coating method and apparatus of the above-mentioned (II) results from such fluctuations in the lift. A width of the fluctuations amounts to as large as several tens $\mu$. This phenomenon can be analyzed as follows. The basic cause locates in fluctuations in a tensile force of the support and this will cause fluctuations in T/R, i.e., in the back pressure. In addition, there are further caused fluctuations in the jet amount of gas in this case, so that fluctuations in the lift are increased so much.

Gas is jetted from the gas injector at all times, because a pressure difference between the supply pressure and the supporting static pressure serves as a driving force. But, when the lift is fluctuated along with fluctuations in the back pressure, the supporting static pressure is fluctuated to become equal to the back pressure as previously described. Therefore, an increase in the back pressure, for instance, decreases the lift thereby to increase the supporting static pressure. Assuming now that the supply pressure is constant, the aforesaid pressure difference is decreased and hence the jet amount of gas is also decreased, so that reduction in the lift is amplified. This is applicable to the case that the back pressure is decreased. Consequently, fluctuations in the lift is amplified in either case.

The inventors have accomplished this invention based on grasping of the above-mentioned phenomenon, and have succeeded in preventing the occurrence of coating uneveness in the form of horizontal steps by keeping a gas amount jetted from the outer surface of the gas injector in the contactless supporting region at a constant level. In other words, even if there cause fluctuations in a tensile force of the support due to external disturbances, fluctuations in the lift are minimized with the jet amount of gas not being subjected to the above-mentioned fluctuations, whereby coating uneveness in the form of horizontal steps is not induced.

BEST MODE FOR CARRYING OUT THE INVENTION

In the following, the coating method according to this invention will be described in detail with reference to one example of the coating apparatus adapted to practice the present coating method.

Figure 1:
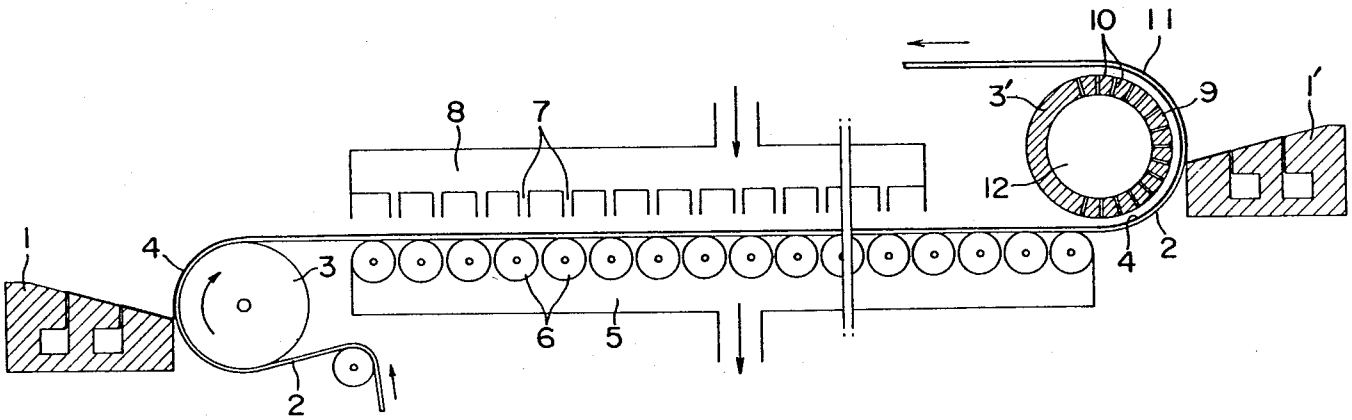
FIG. 1 is a longitudinal sectional view of a coating apparatus according to one embodiment of this invention, showing such a case that the double coating system using slide hoppers is adopted as a coating method and both sides of the support are coated continuously.
Figure 2:
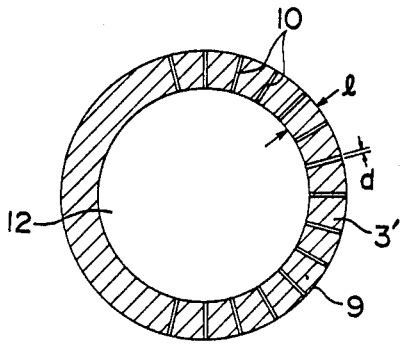
FIG. 2 is a longitudinal sectional view showing one example of a gas injector used in this invention.
Figure 3:
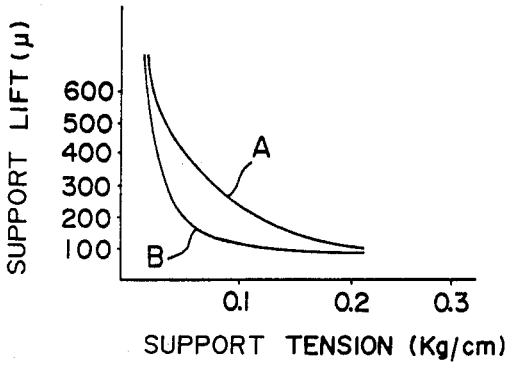
FIG. 3 is a graph showing a relationship between a tensile force exerted on the support and a lift of the support at the contactless supporting portion, in which a curve A represents the prior art and a curve B represents this invention.

FIG. 1 is a longitudinal sectional view of the coating apparatus according to one embodiment of this invention, and it shows such a case that the double coating system using slide hoppers is adopted as a coating method, and both sides of the support are coated continuously. FIG. 2 is a longitudinal sectional view showing one example of a gas injector used in this invention. FIG. 3 is a graph showing a relationship between a tensile force exerted on the support and a lift of the support at the portion in contact with a coating solution in the contactless supporting portion, in which curve A represents the prior art and a curve B represents this invention.

Referring to FIG. 1, a support 2 to be coated is first brought into direct-contact with a supporting roll 3, and coating is applied on the support by means of the conventional well-known method by means of a coater 1. To gelatinize an applied coating layer 4, the support 2 is made to pass through a cooled air zone 8. In cooled air zone 8, cooled air hits upon the coating layer 4 through a slit plate or small holes 7. In order to further increase cooling efficiency, the side of the support 2 including no coating layer is brought into contact with a group of rolls 6 which are arranged with intervals of 2 through 3 mm and are set in a central box 5. It is preferable to suck the support from the opposite side so as to increase a contact area with the rolls 6 and hence to cool and gelatinize the coating layer 4 sufficiently. The support 2 having the gelatinized coating layer 4 is then sent to the contactless supporting region of a gas injector 3', where another coating layer 11 is applied on the opposite side of the support 2 by means of a coater 1' provided confronting to the gas injector 3' with the support therebetween. As the gas injector 3', there can be adopted various types, but a roll type injector is illustrated herein because it can be assumed to be the most general one from the standpoint of ease in manufacturing, etc.

The gas injector 3' is formed of a hollow roll, and a plurality of through holes 10 for jetting gas are formed in the part of its outer shell corresponding to the contactless supporting region. The gas fed into the inside of the injector is jetted from the outer surface 9 of the roll via through holes 10 toward the gelatinized coating layer 4, thereby to support the coated support 2 in the contactless state. In manufacturing of photosensitive materials, it is usually required to hold fluctuations in thickness of the coated layer within 1% in the wet state or after drying. To meet such condition, it is necessary that a gap between the leading end of the coater 1' and the side of the support to be now coated is maintained as constant as possible. As a result of intensive study, it was clarified that an allowable fluctuation width of this gap must be held less than 10μ at maximum, and preferably within several μ.

According to this invention, in case that the gas injector 3' is formed of the hollow roll having through holes 10, a ratio of the supporting static pressure (i.e., back pressure) to the supply pressure and a lift at the coating solution contact point can be made to have one value in a range of 1/10 through 1/1000 and 20 through 500μ, respectively, through adjustment of both the support tensile force and the supply pressure, by properly setting a diameter d (refer to FIG. 2) and a length l (refer to FIG. 2) at the narrowest portion of each through hole 10, an opening factor (i.e., ratio of the total sectional area at the narrowest portions of the respective through hole 10 to the overall surface area of the gas injector 3' in the contactless supporting region) as well as an outer diameter of the roll. With this, it becomes possible to hold fluctuations in the lift of the flexible support to be coated within the above-mentioned allowable width. Hereinafter, description will be made on such adjustment.

Main causes for causing fluctuations of the coated support 2 are in that when the support 2 passes through the contactless supporting region corresponding to the curved surface 9 of the gas injector after application of the coating layer 11, it comes into the free state where it undergoes no supporting temporarily and hence the support 2 is swung in the direction perpendicular to its running direction, and that a tensile force exerted on the support 2 is fluctuated due to the transfer system itself.

Therefore, in order to study a relationship between fluctuations in a tensile force exerted on the support 2 and fluctuations in a lift, a tensile force applied to the support 2 was varied and a distance between the outer surface 9 of the gas injector and the surface of the gelatinized coating layer 4, i.e., a lift, was measured at the coating solution contact point in the contactless supporting region. Thus measured result is shown in a graph of FIG. 3.

Both curves A and B in FIG. 3 show the results of measurements carried out using the gas injector 3' which is formed of the hollow rolls (refer to FIG. 2) having the plural through holes 10 in its outer shell. As to the curve A, assuming now that a radius of the outer surface of the roll is 100 mm, a diameter d of each gas jet hole is 2 mm, a length l thereof is 5 mm, an opening factor is 1% and supply pressure is 0.05 $Kg/cm^2$, back pressure assumes 0.01 $Kg/cm^2$ and a lift assumes about 250μ with a support tensile force being set at 0.1 Kg/cm. In this case, a ratio of the supporting static pressure and the supply pressure is 1/5, and if the tensile force is subjected to a change in degree of 10%, i.e., 0.01 Kg/cm, a change in the lift reaches up to several tens μ, thus resulting in coating uneveness in the form of horizontal steps. On the other hand, the curve B represents the result of measurement which was carried out on such conditions that a diameter d of each gas jet hole is 0.3 mm, an opening factor is 0.1%, supply pressure is 0.1 $Kg/cm^2$ and other variables are set at the same values. When a tensile force is selected to be 0.1 Kg/cm in order that a ratio of the supporting static pressure and the supply pressure becomes 1/10, the lift assumes 100μ. In this case, even if there occurs a change in the tensile force of 10%, a change in the lift is held as much as 10μ, so that coating uneveness in the form of horizontal steps will not be produced. In this manner, to prevent the occurrence of coating uneveness in the form of horizontal steps, it is required to maintain fluctuations in the lift as small as possible. For this purpose, it is preferable that a tangential line of the curve approaches a horizontal one in a range of the usually employed tensile force as close as possible in the graph of FIG. 3. From this viewpoint, as will be apparent from FIG. 3, the tensile force and the lift are preferred to be possibly increased and decreased, respectively. However, both of such increase and decrease are practically limited to a certain degree because of finite strength of the support, specific problems in the transfer system as well as danger of contact in the contactless supporting region. Thus, the technical object to be achieved is to set conditions based on the curve B rather than the curve A. A practical means for achieving this technical object is to use such a gas injector which can offer a substantially invariable jet amount of gas at all times, even if there occur fluctuations in the support tensile force, i.e., in the supporting static pressure, as previously noted. It is an ideal method that the supply pressure is changed in response to fluctuations in the support tensile force so as to offer such a jet amount of gas as holding the lift constant at all times. However, it is very difficult to change the supply pressure promptly in response to abrupt fluctuations in the support tensile force. In practice, even if such change in the supply pressure is carried out, there occurs a time lag in response when the supply pressure and the jet amount are changed, so that unstability of the lift is increased unexpectedly.

In this invention, therefore, the jet amount of gas is held invariable by maintaining a pressure difference between the supply pressure and the supporting static pressure, which serves as a driving force for gas injection, at a constant level. A main cause by which the pressure difference is fluctuated locates in fluctuations in the supporting static pressure along with fluctuations in the support tensile force. Oftenly this leads to fluctuations even in the supply pressure. But, such a technique that the supply pressure is changed in response to fluctuations in the supporting static pressure to hold the pressure difference constant, is similar to the above-mentioned method and has problems such as a time lag in response, so that the foregoing object can not achieved. Thus, according to this invention, the supply pressure is set sufficiently high comparing with the supporting static pressure and influence of a change in the supporting static pressure upon the pressure difference is made small relatively, whereby the pressure difference is not fluctuated substantially even if there occur fluctuations in the supporting static pressure. For instance, if the supply pressure is set ten times as much as the supporting static pressure, fluctuations in the pressure difference assumes about 1% even with the supporting static pressure being fluctuated in a degree of 10%.

Another technical object to be achieved herein is an absolute magnitude of lift of the support. As will be seen from FIG. 3, as the lift is increased up to a considerable degree, it will be largely fluctuated with respect to slight fluctuations in the tensile force. This results from the fact that the supporting static pressure is maintained by channel resistance in the gap between the support 2 and the outer surface 9 of the gas injector, and that with the lift increasing, dependency of the channel resistance upon a width of the gap, i.e., a lift, becomes smaller, whereby the lift is largely fluctuated in accordance with a slight change in the channel resistance. In this way, to hold fluctuations in the lift at minimum, it is also required to set an absolute magnitude of the lift at not so large degree. As previously noted, the reason why fluctuations in the lift must be held small is in keeping a gap between the leading end of the coater 1' and the side of the support 2 to be coated at a constant extent. So it is not necessarily required to restrict fluctuations over all the contactless supporting region, and there will occur no particular problem, if fluctuations in the lift at the coating solution contact point which directly affects a width of the gap is held less than 10μ as mentioned above. Thus, an absolute magnitude of the lift may be also controlled to have a value within the required range at least at the coating solution contact point. This range is selected to be less than 500μ from the above-mentioned reason. On the other hand, the minimum limit of the lift is determined in view of the possibility of such a danger that the outer surface of the gas injector may come into contact with the support or the coating layer applied thereon. As a result of study, the inventors have found that the preferable minimum limit is 20μ.

Furthermore, as a result of study on the gas injector based on the foregoing conditions that the jet amount of gas is held constant and an absolute value of the lift must not be set at so much degree, it is also found that the necessary and sufficient condition required for the gas injector is to cause a large pressure loss during a period from inlet of the supplied gas to outlet thereof.

Based on the above-mentioned view, the inventors have continued intensive study through various experiments. As a result, in case of coating where highly uniform distribution in a film thickness is required like photosensitive materials, etc., it has succeeded to hold fluctuations in the lift due to external disturbances within an allowable range in such a manner that the construction of the gas injector 3', the supply pressure and the support tensile force are adjusted so that the supporting static pressure and the lift are made to have a certain value in a range of 1/10 through 1/1000 of the supply pressure and in a range of 20 through 500μ at the coating solution contact point, respectively, and that the support is contactlessly supported in such adjusted conditions.

The supply pressure in this invention is preferably in a range of 0.05 through 5 $Kg/cm^2$. With the supply pressure being equal to or less than 0.05 $Kg/cm^2$, the back pressure becomes equal to or less than 0.005 $Kg/cm^2$ to attain the satisfactorious supporting static pressure. Thus, slight external disturbances can cause relatively so much fluctuations in the back pressure, thereby resulting in a fear of remarkable fluctuations in the lift. On the other hand, as to the case that the supply pressure exceeds 5 $Kg/cm^2$, it is preferred theoretically that the supply pressure is increased as high as possible. In practice, however, there is a limit in the method used for offering a pressure loss by means of the gas injector, and when the gas injector can not offer a sufficient pressure loss, high pressure gas will be jetted. To hold the lift within an allowable range of this invention in the latter case, a degree of the support tensile force goes beyond a practically possible range. Further, in case of both-side coating, such a phenomenon may be caused that high pressure jet gas will disturb the coating layer which has been already applied. Consequently, the supply pressure is preferably set within 5 $Kg/cm^2$. But, it should be understood that the above-mentioned upper and lower limits of the supply pressure are not included in essentials of this invention, and hence that this invention is also practicable under supply pressure departing from such a range.

A typical example of procedures for practically constituting the gas injector 3' of the present coating apparatus will be described hereinafter.

Firstly, since a practically possible range of the support tensile force is determined in relation to the transfer system, an outer diameter of the hollow roll as a typical example of the gas injector is determined with respect to such a range so that the back pressure locates in a proper range. With this, a range of the supply pressure is determined based on the conditions of this invention. Therefore, after selecting one value from this range, a pressure loss to be imparted to the gas injector is calculated. Then, a value of the opening factor is assumed appropreately in view of the jet amount of gas necessary for attaining the desired lift, and a diameter d as well as a length l of each through hole 10 are calculated with respect to a jetting speed of gas at that time based on the pressure loss to be applied. After that, the practically required jet amount of gas is obtained through experiments, and then an opening factor and a diameter d as well as a length l of the through hole 10 are corrected based on thus obtained jet amount of gas. In this manner, the present gas injector 3' can be attained.

As gas used for effecting the contactless supporting in this invention, there can be employed any gas which causes no problem in terms of safety, such as $N_2$ gas, freon gas or air. Among them, air is most generally used, and it is preferable that air is cooled to temperature of 0° through 10° C. beforehand to prevent solution of the coating layer 4, because its hits upon the gelatinized coating layer 4. After being coated on the opposite side in the contactless supporting region, the support 2 is sent into a not shown cooled air zone where cooled air is made to hit upon both sides of the support in the contactless state thereby to gelatinize the coating layer 11, and then it is transferred into a not shown contactless drying zone. According to this invention, it has been found that even if the coated support is shifted (or vibrated) in the direction perpendicular to the running direction of the coated support in a region where the coating layer 11 is gelatinized in a contactless manner, or in the contactless drying zone, such shift (or vibration) will be absorbed in the contactless supporting region and will not further propagate, so that highly uniform coating can be obtained. Incidentally, as the coated support used in this invention, there can be employed supports for photosensitive materials, such as paper or a plastic film including polyethyleneterephthalate, cellulose triacetate, etc. No particular limitation is applied to a material of the outer surface 9 of the roll in the contactless supporting region, and any material which can endure the inner pressure within a hollow portion 12 is usable. Among many possible materials, preferable one is a stainless steel or a brass having hard chromium plating applied thereon. In case that the plural through holes 10 are formed like the illustrated embodiment, plastic materials such as bakelite or acryl resin may be used from the viewpoint of ease in boring.

Furthermore, when practicing this invention, it is preferred that temperature of the coating layer 4 immediately prior to entering into the contactless supporting region is reduced down to 2° through 10° C., more preferably 2° through 5° C. to increase gelatinized strength of the coating layer 4, in order that air hitting upon the gelatinized coating layer 4 in the contactless supporting region may not disturb the coating layer 4 due to its dynamic pressure.

Industrial Applicability

This invention has many effects as follows.

(1) In the coating zone where the opposite side of the support is continuously coated while keeping the gelatinized coating surface out of contact, after applying one or more coating solution such as a photosensitive solution on one side of the support and then gelatinizing the coating layer, the support is floated and fluctuations in its lift is restricted with a simple apparatus without a need of using an intricate apparatus, so as to hold a gap between the leading end of the coater and the side of the support to be coated at a constant degree correctly, thus resulting in highly uniform coating.

(2) With this, since both sides of the support can be coated almost at the same time by passing it through the coating and drying process only one time, it is possible to increase production efficiency to a great extent.

(3) Also when coating only one side of the support, contactless supporting coating can be performed in place of prior contact supporting by the use of a roll, whereby it becomes possible to prevent such a transferring phenomenon that dusts adhered onto the gas injector adversely affect the coating layer.

Figure 4:
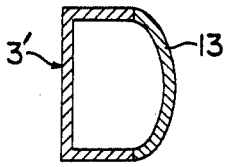
FIG. 4 is a longitudinal sectional view showing another example of the gas injector used in this invention.

Although this invention has been explained by mainly referring to FIGS. 1 through 3 in the above, embodiments of this invention are not limited to the illustrated one. As the gas injector, there can be used any type which has the continuous curved face as its outer surface in the contactless supporting region to maintain high static pressure in a gap between the support and the outer surface, which can jet gas from its curved face, and which meets the conditions of this invention. It is not necessarily required that the gas injector must have a roll-like outer shape or that the portion allowing gas to pass from the inside to the outside of the gas injector must be through holes, and the coating apparatus may include a gas injector which has a construction other than the above. For instance, the gas injector may have a semicylindrical shape as well as an ellipse shape, and further it may modified into such a shape as shown in FIG. 4, there is illustrated another example of the gas injector, that only the contactless supporting region has the curved outer surface and other regions have flat surfaces. As to a shape of the gas injector, the factor to be considered is a radius of curvature of the outer surface in the contactless supporting region at the portion corresponding to the coating solution contact point. The support is contactlessly supported and its lift is very small, so that a curvature of the curved support becomes substantially equal to that of the outer surface of the gas injector. Since a tensile force exerted on the support is same everywhere, back pressure in the contactless supporting region is determined by a radius of outer surface curvature of the gas injector.

As previously noted, if back pressure is too small, the lift tends to fluctuate, while if it is too large conversely, it becomes difficult to produce the corresponding supporting static pressure. That is, the back pressure has a specific preferred range. Therefore, it is also preferable that a radius of outer surface curvature of the gas injector is set within a certain range in accordance with a practically possible range of the support tensile force. This is very significant particularly at the coating solution contact point where fluctuations in the lift must be minimized. According to study by the inventors, such a preferable range was 30 through 200 mm. On the other hand, as to the portion which allows gas supplied to the inside of the air injector to pass toward the outside, this portion serves to pass the supplied gas therethrough as well as to offer a pressure loss. There can be adopted any type construction which satisfies the above conditions. In case of forming through holes, they can have a circular shape or a polygonal shape. Alternately, as shown in FIG. 4, porous materials such as a sintered metal may be used to constitute the outer shell of the gas injector in the contactless supporting region. It is also possible that the gas injector has not hollow portion and it is formed of porous materials entirely from its gas inlet to its outer surface in the contactless supporting region.

Furthermore, for coating either one side and opposite side of the support, there can be employed desirous well-known methods such as a bead coating method, extrusion coating method or a natural flow coating method. In addition, it will be noted that the construction of the gas injector used in this invention can be referred to the construction of a roll serving as a gas injector disclosed in Japanese Patent Application No. 136,984/1980.

Practical examples of this invention will be described hereinafter.

EXAMPLE 1

In the coating apparatus shown in FIG. 1, the gas injector 3' was formed of a hollow roll having a plurality of gas jetting through holes 10 (refer to FIG. 2). A radius of the outer surface of the roll was set at 100 mm, each through hole 10 was made to assume a circular one with a diameter d of 0.08 mm and a length l of 10 mm, an opening factor is set at 0.02%, and air cooled down to about 5° C. was supplied to the hollow portion of the roll under gauge pressure of 2 $Kg/cm^2$ to jet the same via through holes 10. A tensile force of 0.1 Kg/cm-width was applied to a polyethyleneterephthalate film with a thickness of 0.18 mm, and this film was subjected to two-layer simultaneous coating while feeding it at a speed of 60 m/min, so that a film thickness in the wet state becomes 60μ and 20μ for a lower layer formed of halogenated silver emulsion for a roentgenograph including gelatine as a binder and for an upper layer formed of a protective gelatine aqueous solution, respectively. Subsequently, cooled air with temperature of about 5° C. was blown against the coating layer 4 through a slit plate 7 to effect gelation, and then similar two-layer simultaneous coating was carried out using another coater 1' under the same conditions as those for the coater 1 while supporting the support contactlessly in the contactless supporting region under the above-mentioned conditions. Thereafter, the coating layer 11 was gelatinized and then both coated sides of the support were dried. The supporting static pressure (i.e., back pressure) assumed 1/200 of the supply pressure, and the lift assumed 150μ at the coating solution contact point of the coater 1'. Thus obtained coating layer 11 did not include any coating uneveness in the form of horizontal steps and any failure, and it was finished to have a highly uniform film thickness. Also, no problem appeared on the coating layer 4.

EXAMPLE 2

In Example 1, both-sided coating was carried out on conditions that only a feeding speed is changed to 100 m/min and all other variables are set at the same values. After drying, there could be attained good coating layers on both sides which included no coating failure and had a highly uniform film thickness, similarly to Example 1.

EXAMPLE 3

In Example 1, the contact supporting roll 3 corresponding to the coater 1 was replaced of a gas injector having the same construction as the gas injector 3', and all other conditions were held unchanged. Both-sided coating was carried out using the coating apparatus which effected contactless supporting under the same conditions. After drying, there could be attained good coating layers on both sides which included no coating failure and had a highly uniform film thickness, similarly to Example 1.

EXAMPLE 4

In the coating apparatus shown in FIG. 1, the gas injector 3' had a shape as shown in FIG. 4 and its gas passing portion 13 was constituted by a sintered metal corresponding to a filter having filtration accuracy of 1μ. This portion 13 was made to have a thickness of 15 mm so as to allow gas to pass therethrough, and cooled air at about 5° C. was supplied into the hollow portion at pressure gauge of 0.1 $Kg/cm^2$ and then jetted from the gas passing portion. A tensile force of 0.1 Kg/cm-width was applied to a polyethyleneterephthalate film with a thickness of 0.1 mm, and this film was subjected to two-layer simultaneous coating while feeding it at a speed of 80 m/min, so that a film thickness in the wet state becomes 65μ and 25μ for a lower layer formed of a gelatine aqueous solution including halation preventive pigments for printing sensitive materials solved therein and for an upper layer formed of a protective gelatine aqueous solution, respectively. Subsequently, cooled air at about 5° C. was blown against the coating layer 4 through a slit plate 7 to effect gelation, and then another two-layer simultaneous coating was carried out under the same conditions while supporting the support contactlessly in the contactless supporting region under the above-mentioned conditions, so that a film thickness in the wet state becomes 60μ and 20μ for a lower layer formed of halogenated silver emulsion for printing sensitive materials and for an upper layer formed of a protective gelatine aqueous solution, respectively. Thereafter, the coating layer 11 was gelatinized and then both coated sides of the support were dried. In this Example, since a radius of outer surface curvature of the gas injector corresponding to the coating solution contact point of the coater 1' was set at 200 mm, the supporting static pressure (i.e., back pressure) assumed 1/20 of the supply pressure, and the lift assumed 300μ at the coating solution contact point of the coater 1'. Thus obtained coating layer 11 did not include any coating failure in the form of horizontal steps and had a highly uniform film thickness. That is, the coating layer 11 was finished with high quality together with coating layer 4.

We claim:

1. In a coating method wherein a coater and a gas injector are disposed in positions substantially opposite to each other on both sides of a support running continuously, and gas is jetted from said gas injector toward said support to coat it by said coater while supporting said support in a contactless manner, the improvement in that supply pressure of gas fed into said injector, a pressure loss in the inside of said injector and a tensile force applied to said support are set prior to coating so that supporting static pressure produced in a gap between said support and said injector becomes 1/10 through 1/1000 of the supply pressure, and a lift at the contact point with a coating solution from said coater has a value of 20 through 500μ.

2. In a coating apparatus wherein a coater and a gas injector are disposed in positions substantially opposite to each other on both sides of a support running continuously, and gas is jetted from said gas injector toward said support to coat it by said coater while supporting said support in a contactless manner, the improvement in that are included a regulator for supply pressure of gas fed into said injector and a regulator for a tensile force applied to said support which can make it possible that supporting static pressure produced in a gap between said support and said injector becomes 1/10 through 1/1000 of the supply pressure, and a lift at the contact point with a coating solution from said coater has a value of 20 through 500μ.

* * * * *